US006443859B1

(12) United States Patent
Markin

(10) Patent No.: US 6,443,859 B1
(45) Date of Patent: Sep. 3, 2002

(54) BASEBALL TRAINING APPARATUS

(75) Inventor: Craig Markin, Copley, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 09/746,825

(22) Filed: Dec. 22, 2000

(51) Int. Cl.[7] ..... A63B 69/00; A63B 71/00; F41B 15/00

(52) U.S. Cl. ..... 473/451; 473/17; 124/6; 124/78

(58) Field of Search ..... 473/417, 422, 473/451–453, 132–134; 273/387, 393, 398; 124/5–7, 48, 50, 78

(56) References Cited

U.S. PATENT DOCUMENTS

| | | | | | |
|---|---|---|---|---|---|
| 1,211,738 | A | | 1/1917 | Marty | |
| 1,400,058 | A | | 12/1921 | Harvey | |
| 4,025,071 | A | | 5/1977 | Hodges | |
| 4,080,950 | A | | 3/1978 | Paulson et al. | |
| 4,191,374 | A | | 3/1980 | Kulesza et al. | |
| 4,207,857 | A | * | 6/1980 | Balka, Jr. | 124/50 |
| RE30,703 | E | | 8/1981 | Paulson et al. | |
| 4,323,047 | A | | 4/1982 | McIntosh et al. | |
| 4,552,120 | A | | 11/1985 | Nall et al. | |
| 4,672,942 | A | | 6/1987 | Steward | |
| 4,705,014 | A | | 11/1987 | Kahelin | |
| 4,834,375 | A | * | 5/1989 | Elstein et al. | 473/417 |
| 4,865,318 | A | | 9/1989 | Lehmann et al. | |
| 4,875,459 | A | | 10/1989 | Van Elderen et al. | |
| 4,915,384 | A | * | 4/1990 | Bear | 473/451 |
| 5,097,985 | A | * | 3/1992 | Jones | 124/48 |
| 5,160,131 | A | * | 11/1992 | Leon | 473/451 |
| 5,207,421 | A | | 5/1993 | Gorvin | |
| 5,294,109 | A | * | 3/1994 | Meade | 124/50 |
| 5,396,876 | A | | 3/1995 | LisciO et al. | |
| 5,417,196 | A | * | 5/1995 | Morrison et al. | 124/6 |
| 5,590,876 | A | | 1/1997 | Sejnowski | |
| 5,597,160 | A | | 1/1997 | Mims | |
| 5,607,151 | A | | 3/1997 | Daley | |
| 5,613,678 | A | | 3/1997 | McKee et al. | |
| 5,672,124 | A | * | 9/1997 | Pecoraro et al. | 473/417 |
| D399,286 | S | | 10/1998 | Brown et al. | |
| 6,099,417 | A | * | 8/2000 | Brown et al. | 473/417 |
| 6,190,271 | B1 | * | 2/2001 | Rappaport et al. | 124/78 |

* cited by examiner

*Primary Examiner*—Paul T. Sewell
*Assistant Examiner*—Mitra Aryanpour
(74) *Attorney, Agent, or Firm*—Piper Rudnick

(57) ABSTRACT

A baseball training apparatus includes a body, a drive assembly connected to the body, the drive assembly configured to impart motion on to the ball, a ball interface device connected to the body, the ball interface device configured for movement between a first position in which the ball engages the drive assembly and a second position in which the ball is prevented from engaging the drive assembly, and a control system operably coupled to the ball interface device, the control system interacting with the ball interface device such that the ball interface device changes between first and second positions at a predetermined time interval for a predetermined duration. The control system applies the signal to the ball interface device at a predetermined frequency. A ball feeder tube removably connects to the body, the ball feeder tube configured to hold the balls and a ball projection means connected to the body, the ball projection means configured for projecting a ball upward from the body. A baseball training set includes a plurality of balls, a body, a drive assembly connected to the body, a ball interface device connected to the body, a control system coupled to the ball interface device to apply a signal to the ball interface device and a ball feeder tube.

20 Claims, 12 Drawing Sheets

BASEBALL TRAINING APPARATUS

FIELD OF THE INVENTION

The present invention relates generally to the field of athletic training equipment. More particularly, the invention relates to a baseball training apparatus for projecting a ball or holding a ball in an elevated position so that the ball can be hit by a baseball bat.

BACKGROUND OF THE INVENTION

Baseball is a popular sport among all ages in today's society. One of the more challenging aspects to the sport of baseball, particularly for younger players, is swinging a bat to hit a ball that is tossed in the air. Hitting a ball, which is tossed into the air, is one of the most difficult activities to perform for young children with developing motor skills. In order to practice the skills required to hit a baseball, typically a minimum of two people, a pitcher and a batter, are required. In order to allow a single person to practice hitting, a number of conventionally known devices have been developed to suspend or project a ball in the air for hitting. These devices typically include a base having a ball support such as a tee. In tee devices, the ball is placed at the end of a vertically positioned tee where it is hit by a batter. These devices can also include contact levers which when hit by a bat strike and propel the ball positioned at the end of the tee. Other commercially known devices include a mechanism for projecting a single ball from a base. The projection mechanisms can include a strike pad that is manually hit by a user's bat or the user's foot to cause a single ball to be tossed in the air. Alternatively, the mechanism can be a ball support connected to a spring that is manually compressed and held in compression by a pin. When the pin is released, typically by a second user, the spring projects a ball into the air. Other mechanisms can include mechanical or mechanical/pneumatic assemblies that provide a container for a single ball and a time delay between the actuation of a pedal by the user and the projection of the single ball into the air. Other commonly known devices project balls sequentially over long distance in a generally horizontal direction.

Existing ball supporting or ball projecting devices have a number of drawbacks. First, existing ball projecting devices typically project only one ball after contact or actuation by the user. Therefore, the user must reload the device after each ball is projected and then manually re-actuate the device for each ball. This requires a single user to leave a ready batting position to re-actuate the device and then return to the batting position to strike the next ball. This repeated movement in and out of the ready batting position often disrupts the continuity of the batter's stance and swing, and can negatively affect the batter's concentration, particularly for the novice user. Second, many devices provide little or no time between the actuation of the device and the projection of the ball, thereby requiring the user to quickly reach a ready batting position following actuation of the device and then swing a bat at the ball. The lack of sufficient time between actuation of the device and ball projection increases the difficulty level of using the device and can promote poor batting stance and swing practices. Third, the known devices that provide a time delay between the actuation of a pedal by the user and the projection of a single ball into the air provide no warning to the user when the ball will be projected from the device. The lack of a warning signal allows users, particularly young children, to become distracted, leave the ready batting position or lose concentration. Existing ball projection devices for projecting multiple balls sequentially are large, expensive machines which project the balls in a generally horizontal direction and over long distance. Such devices can be unsafe and are not suitable for operation by children, particularly young children. Moreover, such devices are configured for professional use or for use by more advanced athletes.

Accordingly, it would be advantageous to provide a baseball training apparatus capable of holding a plurality of balls and projecting the balls in a generally vertical direction, one at a time at a predetermined time interval, following a single actuation signal. A plurality of single ball projections at a predetermined time interval between projections following a single actuation signal allows the user to establish a ready batting position and maintain that position during multiple swings of a bat. It also allows the user to develop continuity between swings, and more easily adjust his or her batting position. What is needed in part is a baseball training apparatus that provides the user with an audible warning signal that a ball is about to project from the apparatus. A warning signal will assist the user in concentrating and focusing on the ball just prior to the ball's projection. Also, it would be advantageous to provide a baseball training apparatus that is lightweight, inexpensive and easy to operate. Further, it would be advantageous to provide a baseball training apparatus that is durable, safe to use and suitable for outdoor use. What is also needed is a baseball training apparatus that is capable of adapting to the user's skill level. This can range from a tee ball mode of operation where a ball is positioned in a stationary and elevated position that aids the user in developing the initial batting skills to an automatic ball projection mode of operation where a plurality of balls are automatically projected upward one at a time over an extended duration for hitting by a user.

SUMMARY OF THE INVENTION

The present invention provides a baseball training apparatus for use with at least one ball. The baseball training apparatus includes a body, a drive assembly connected to the body, and a ball interface device. The drive assembly is configured to impart motion to the ball. The ball interface device is connected to the body. The ball interface device is configured for movement between a first position in which the ball engages the drive assembly and a second position in which the ball is prevented from engaging the drive assembly. A control system is operably coupled to the ball interface device. The control system interacts with the ball interface device such that the ball interface device changes between first and second positions at a predetermined time interval for a predetermined duration.

According to another aspect of the invention, a baseball training apparatus for use with at least one ball includes a control system applying a signal to a ball interface device at a predetermined frequency. According to another aspect of the invention, a baseball training apparatus for use with at least one ball includes a ball feeder tube removably connected to a body. The ball feeder tube is configured to hold the balls. A ball projection means is connected to the body. The ball projection means is configured for projecting a ball upward from the body.

The present invention also provides a baseball training set. The baseball training set includes a plurality of balls, a body, a drive assembly connected to the body, and a ball interface device. The drive assembly configured to impart motion to the ball. The ball interface device is connected to the body. The ball interface device is configured for movement between a first position in which the ball engages the drive assembly and a second position in which the ball is prevented from engaging the drive assembly. The baseball training set further includes a control system coupled to the ball interface device. The control system applies a signal to the ball interface device such that the ball interface device changes between first and second positions at a predetermined time interval for a predetermine duration. A ball feeder tube has first and second ends. The first end of the tube removably connects to the body and the tube is configured to hold at least one of the balls.

BRIEF DESCRIPTION OF THE DRAWINGS

The invention will become more fully understood from the following detailed description, taken in conjunction with the accompanying drawings, wherein like reference numerals refer to like parts, in which.

DETAILED DESCRIPTION OF THE PREFERRED EMBODIMENTS

Figure 1:
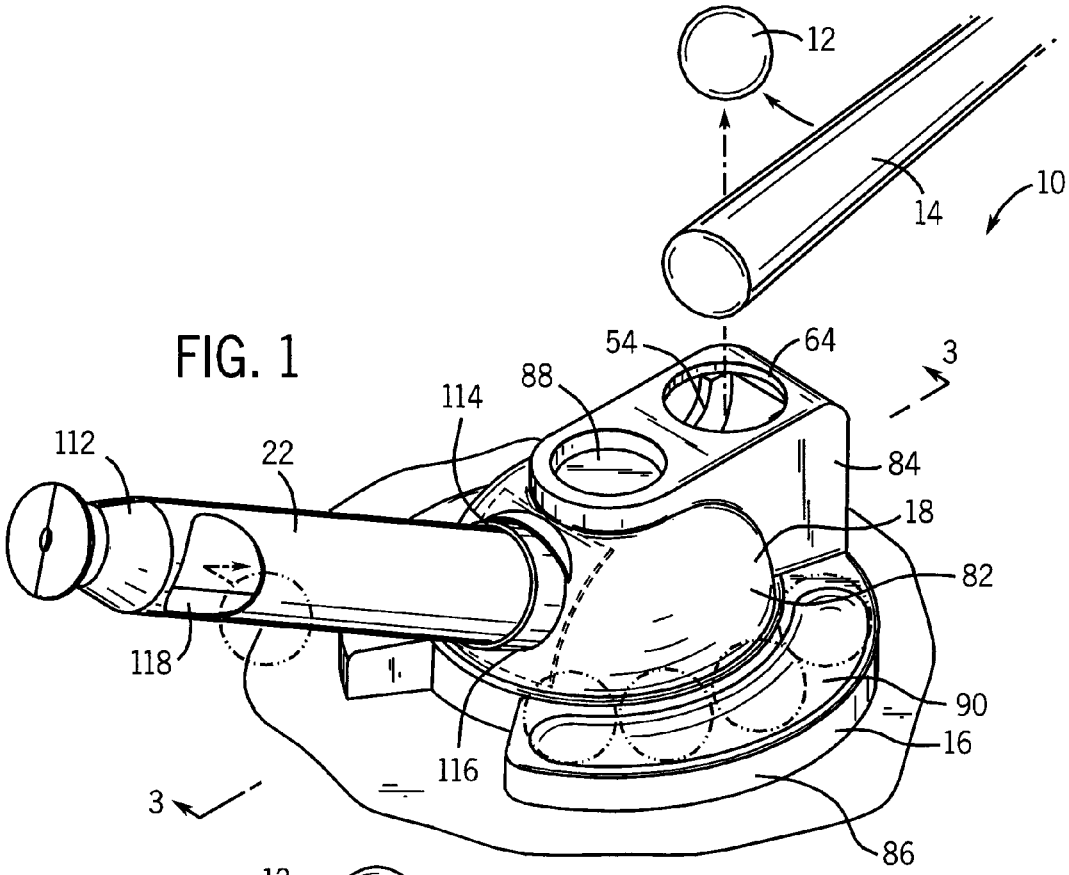
FIG. 1 is a perspective view of a baseball training apparatus in the automatic ball projection mode of operation in accordance with an exemplary embodiment of the present invention.
Figure 2:
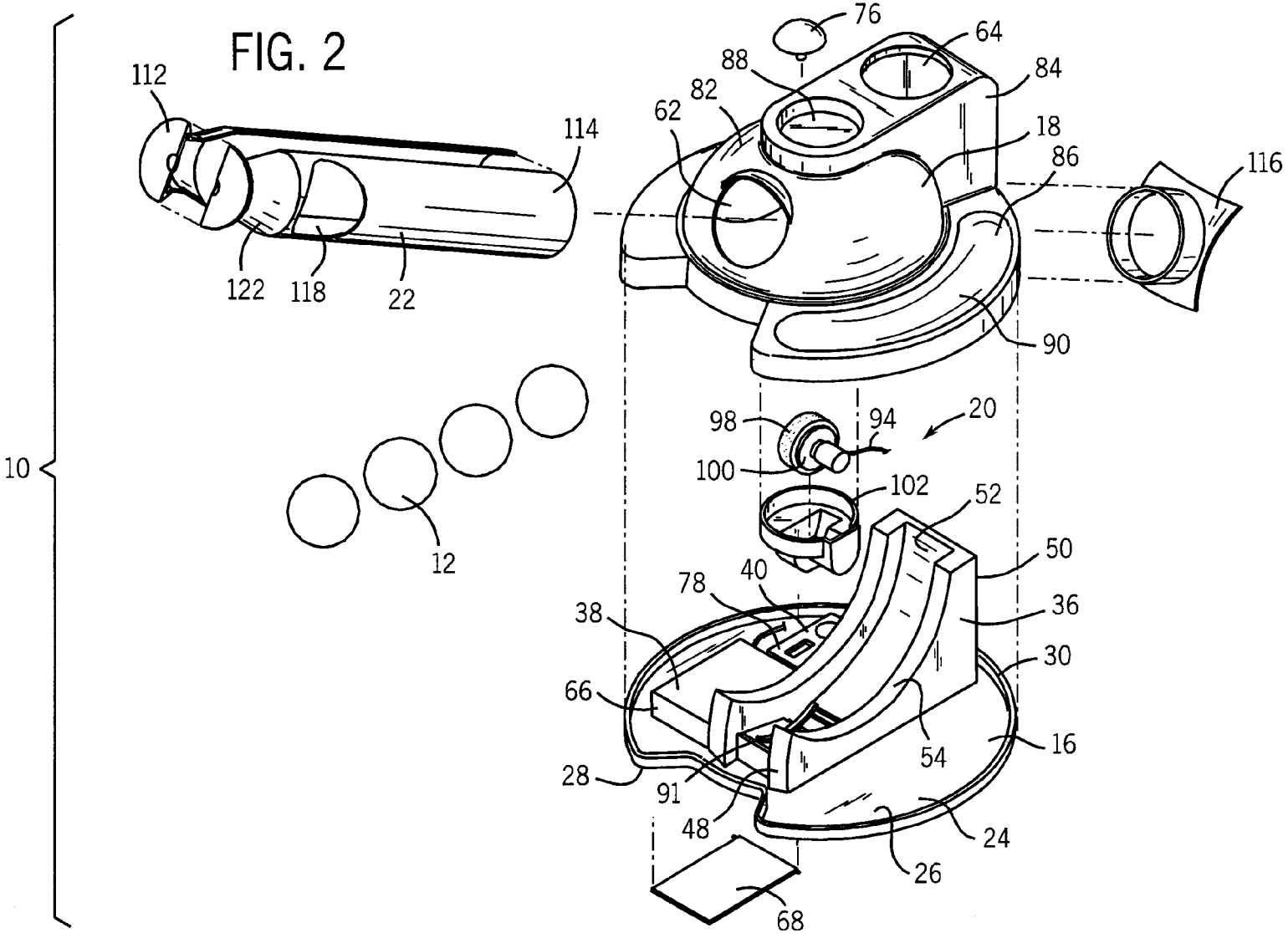
FIG. 2 is an exploded, perspective view of the baseball training apparatus of FIG. 1.
Figure 6:
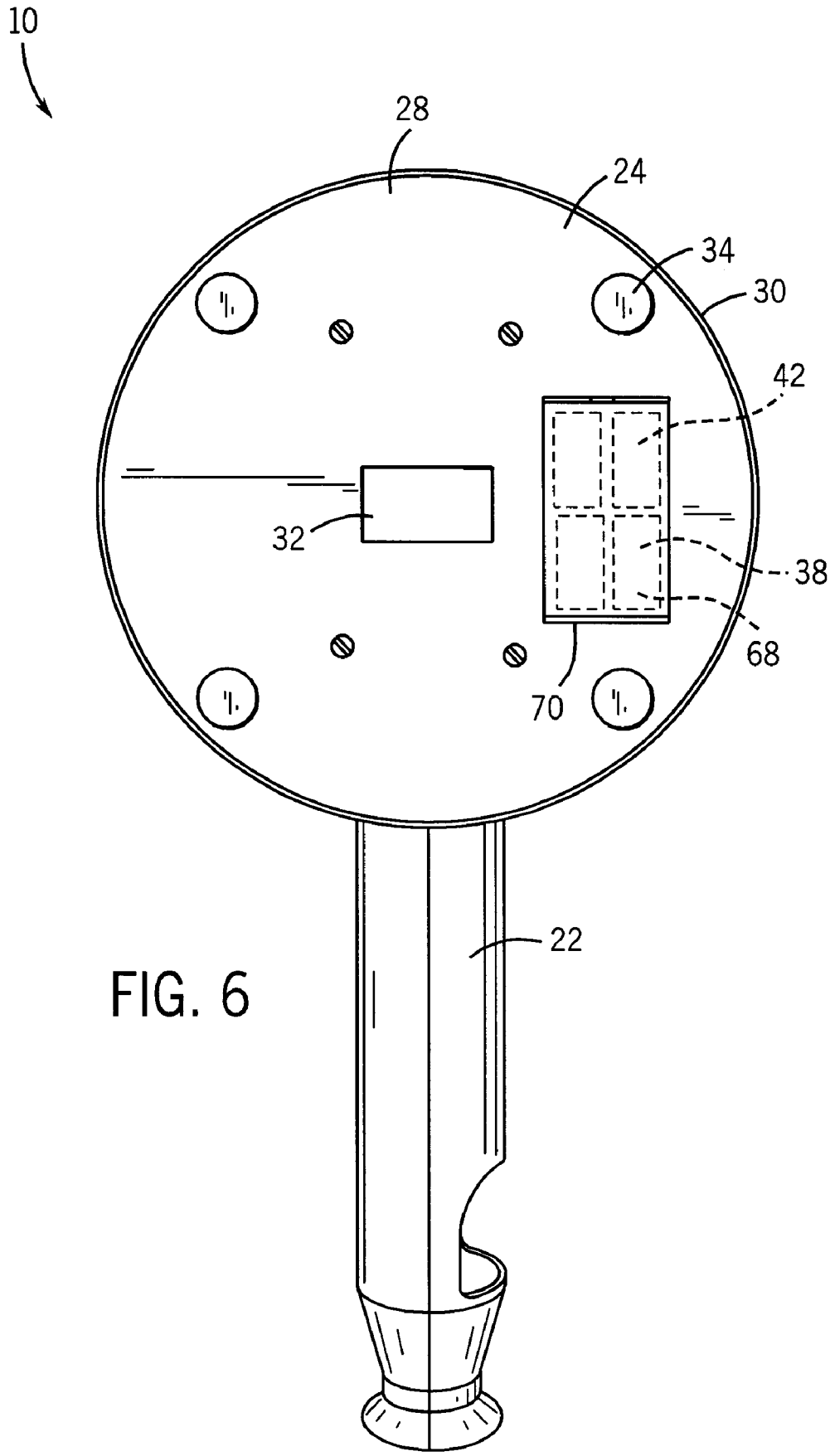
FIG. 6 is a bottom view of the baseball training apparatus of FIG. 1.

Referring to FIGS. 1 and 2, a baseball training apparatus constructed in accordance with an exemplary embodiment of the present invention is shown generally at 10. The apparatus 10 has two modes of operation, an automatic projection mode wherein balls 12 are individually projected upward from the apparatus 10 for striking by a bat 14 and a tee ball mode. The two modes of operation allow the apparatus 10 to be easily adapted to match the user's needs and the user's stage of development. The apparatus 10 generally includes a base 16, a cover 18, a drive assembly 20, a ball interface device and a ball feeder tube 22. The base 16 comprises a circular disk 24 having an upper surface 26, and underside 28 and a ring 30. Referring to FIGS. 2 and 6, the disk 24 further includes at least one drain hole 32. The upper surface 26 is contoured to allow water, such as rain water, to drain from the base 16. The drain hole 32 can be formed in a variety of shapes or sizes. The underside 28 includes a plurality of outwardly extending support surfaces 34 to provide balanced and level support to the base 16. The support surfaces 34 are integrally formed with the disk 24. In alternative embodiments, the support surfaces 34 can be formed in different shapes and can also be formed as separate pieces connected to the disk 24. Referring to FIG. 2, the ring 30 projects upwardly and perpendicularly extends from the perimeter of the disk 24 to facilitate connection of the disk 24 to the cover 18. In an exemplary embodiment, the base 16 and the cover 18 are made of hard plastic. Other conventional materials can also be used such as, for example, wood or aluminum. The base 16 further includes a ramp 36, a power supply 38 and a control system 40.

Figures 3, 4:
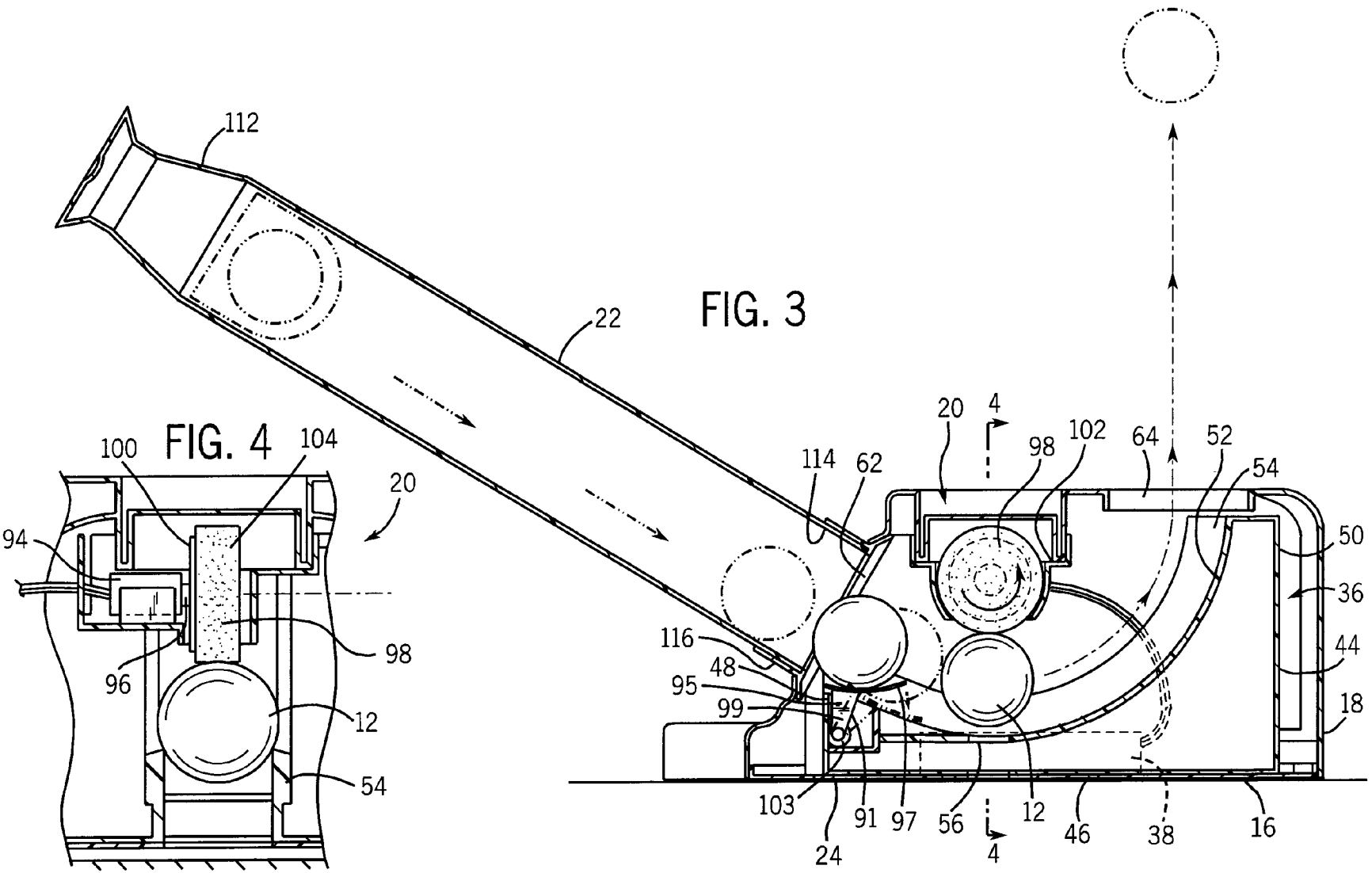
FIG. 3 is a longitudinal cross-sectional view taken substantially along line 3—3 of FIG. 1.
FIG. 4 is a transverse, sectional view of the baseball training apparatus taken substantially along line 4—4 of FIG. 3.

Referring to FIGS. 1 through 3, the ramp 36 includes a frame 44 having a bottom surface 46, inlet and outlet sides 48, 50 positioned perpendicular to the bottom surface 46 and an arcuate top surface 52. The ramp 36 further includes two arcuate rails 54 upwardly extending from the top surface 52. The rails 54 are positioned parallel to one another and are spaced apart by the top surface 52 of the frame 44. The ramp 36 preferably further includes an opening 56 extending through the top surface 52 to the bottom surface 46. The opening 56 is configured to enable water or small objects entering the apparatus 10 to pass below the top surface 52 of the ramp 36. The bottom surface 46 of the ramp 36 is connected to the disk 24. The rails 54 support the ball 12 as it exits a ball feeder tube 22 and comes into contact with the rails 54 at inlet side 48 until the ball 12 exits the rails 54 near the outlet side 50. The spaced apart configuration of the rails 54 allows the rails 54 to only support objects of the size of the ball 12. Smaller objects entering the apparatus 10 and contacting the ramp 36 pass between the rails 54 and away from contact with the drive assembly 20. The size of the ball feeder tube 22, and the ball inlet and the ball outlet openings 62, 64 of the cover 18 inhibit objects larger than the ball 12 from entering the apparatus 10. The spaced apart feature of the rails 54 prevents the apparatus 10 from projecting unintended objects dropped therein and thus assists in ensuring safe operation of the apparatus 10. According to an exemplary embodiment, the ramp 36 is made of hard plastic, but other conventional materials such as wood, aluminum, etc. can be used.

Referring to FIGS. 2 and 6, the power supply 38 includes a power supply case 66 and a removable lid 68. The power supply case 66 is connected to the disk 24 at a power supply opening 70. The power supply case 66 is positioned adjacent to the ramp 36 and upwardly extends from the disk 24. The power supply case 66 is configured to hold at least one battery 42. In an exemplary embodiment, the power supply case 66 is sized to hold four 1.5 volt batteries. Other battery combinations and sizes can be also used. The lid 68 removably connects to the power supply case 66 at the underside 28 of the disk 24, thereby making the battery 42 accessible from the underside 28 of the disk 24. The power supply 38 is operably coupled to the drive assembly 20, the control system 40 and a ball interface device.

Figure 11:
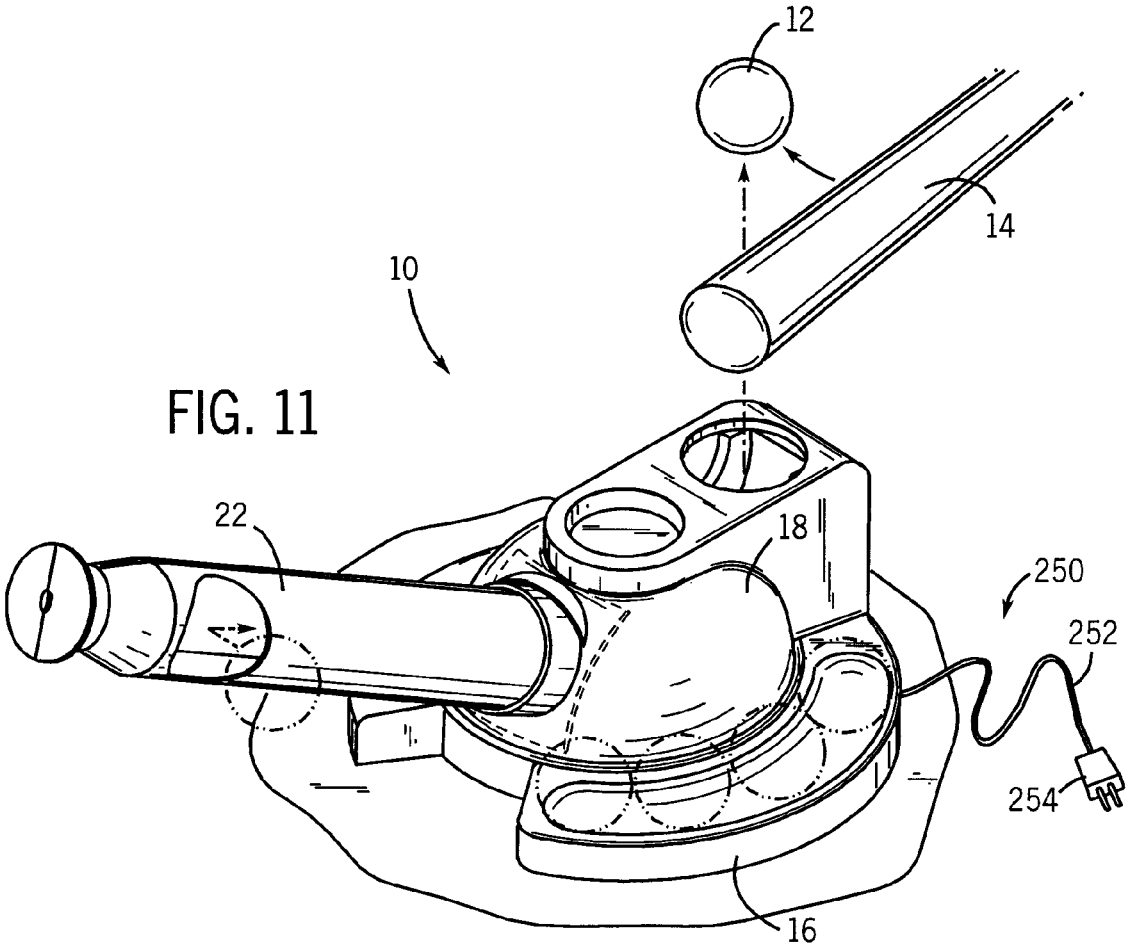
FIG. 11 is a perspective view of a baseball training apparatus in an automatic ball projection mode of operation in accordance with an alternative exemplary embodiment of the present invention.

Referring to FIG. 11, in an alternative exemplary embodiment, the apparatus 10 further includes a power cord assembly 250. The power cord assembly 250, is electrically coupled to the base 16 at the drive assembly 20 and the control system 40. The power cord assembly 250 enables the apparatus 10 to operate under power supplied by a remote power source. The power cord assembly 250 includes a cord 252 and a plug 254. The apparatus 10 can be configured with one or both of the power supply 38 (FIG. 2) and the power cord assembly 250.

Figure 9:
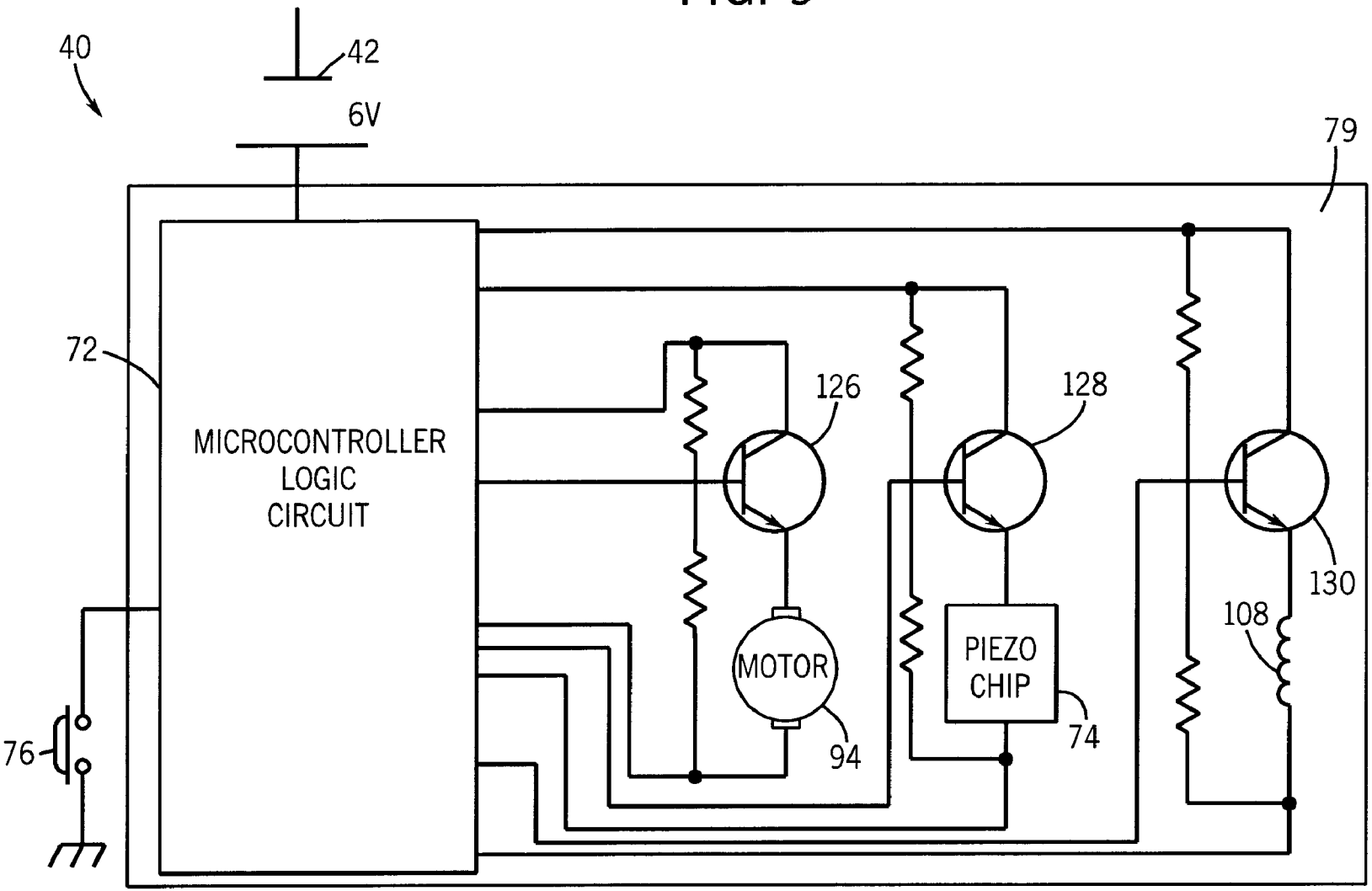
FIG. 9 is an electronic circuit diagram of the control system of a baseball training apparatus in accordance with an exemplary embodiment of the present invention.

Referring to FIGS. 2 and 9, the control system 40 includes a microcontroller 72, a plurality of transistors 126, 128, 130, a piezo-electric sound emitting chip 74 and a pushbutton 76. The control system 40 further includes a control circuit case 78 (see FIG. 2). Referring to FIG. 9, the control system 40 further includes a circuit board 79 having the microcontroller 72, the transistors 126, 128, 130 and the piezo-electric chip 74. Referring to FIG. 2, the control circuit case 78 is connected to the upper surface 26 of the disk 24 adjacent to the ramp 36 and protects circuit components from water or debris. The pushbutton 76 is positioned above the control circuit case 78 and is operably coupled to the control system 40. In an exemplary embodiment, the pushbutton 76 is configured for foot actuation of the apparatus 10 by the user. The pushbutton 76 includes a flange that seals the pushbutton 76 against the cover 18 when the pushbutton 76 is not depressed. The flange prevents moisture and debris from entering the apparatus 10 at the pushbutton 76. Further discussion of the control system 40 and its logic is provided below.

Figure 12:
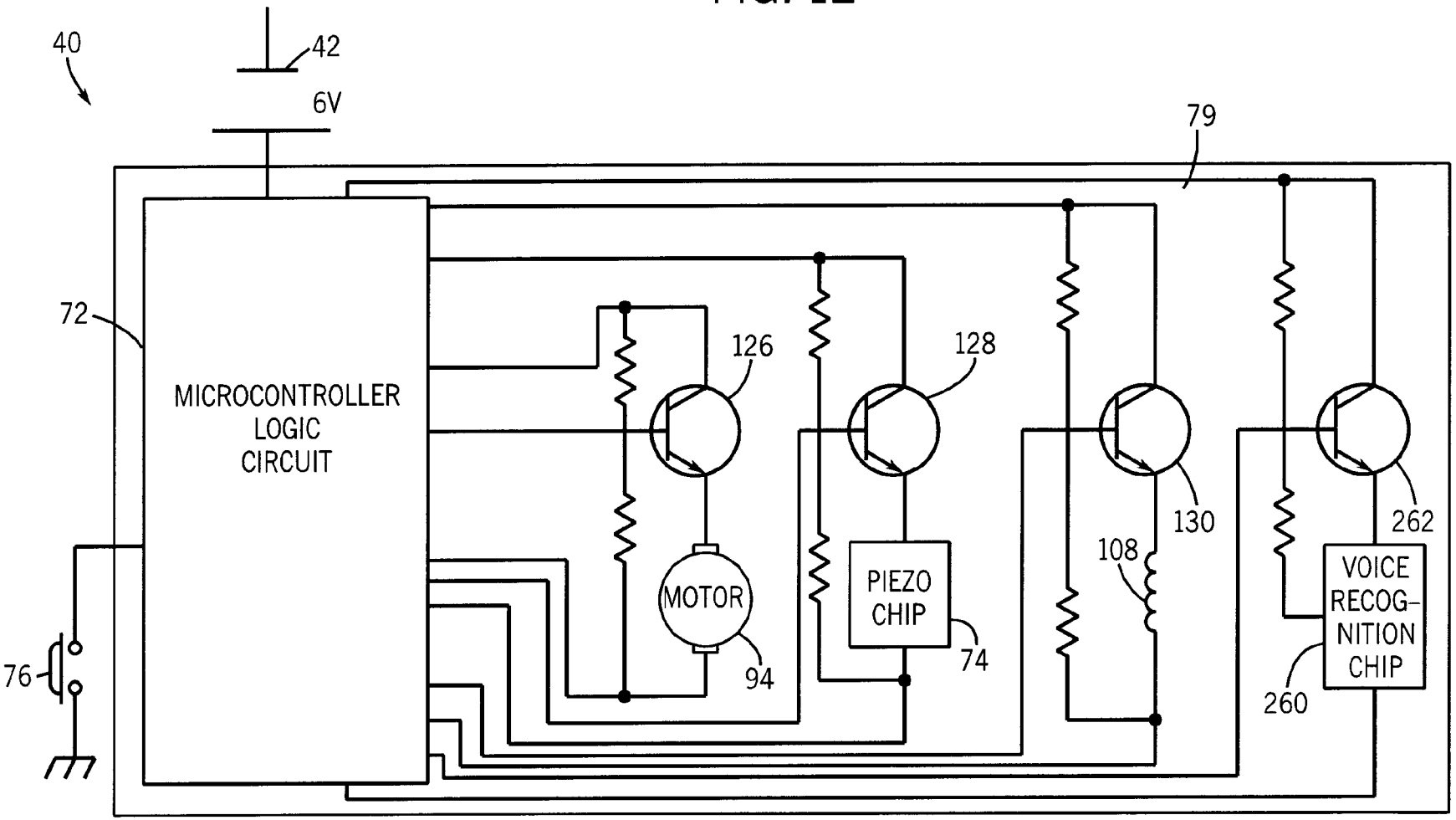
FIG. 12 is an electronic circuit diagram of the control system of a baseball training apparatus in accordance with another alternative exemplary embodiment of the present invention.

In an alternative exemplary embodiment, as shown in FIG. 12, the control system further includes a voice recognition module 260 and a fourth transistor 262. The voice recognition module 260 and the fourth transistor 262 are connected to one another and to the microcontroller 72. The voice recognition module 260 is configured to convert a verbal sound or command into a command signal which is sensed by microcontroller 72. In one embodiment, the microcontroller 72 then initiates a signal to the ball interface device causing the ball interface device to change positions.

Figure 5:
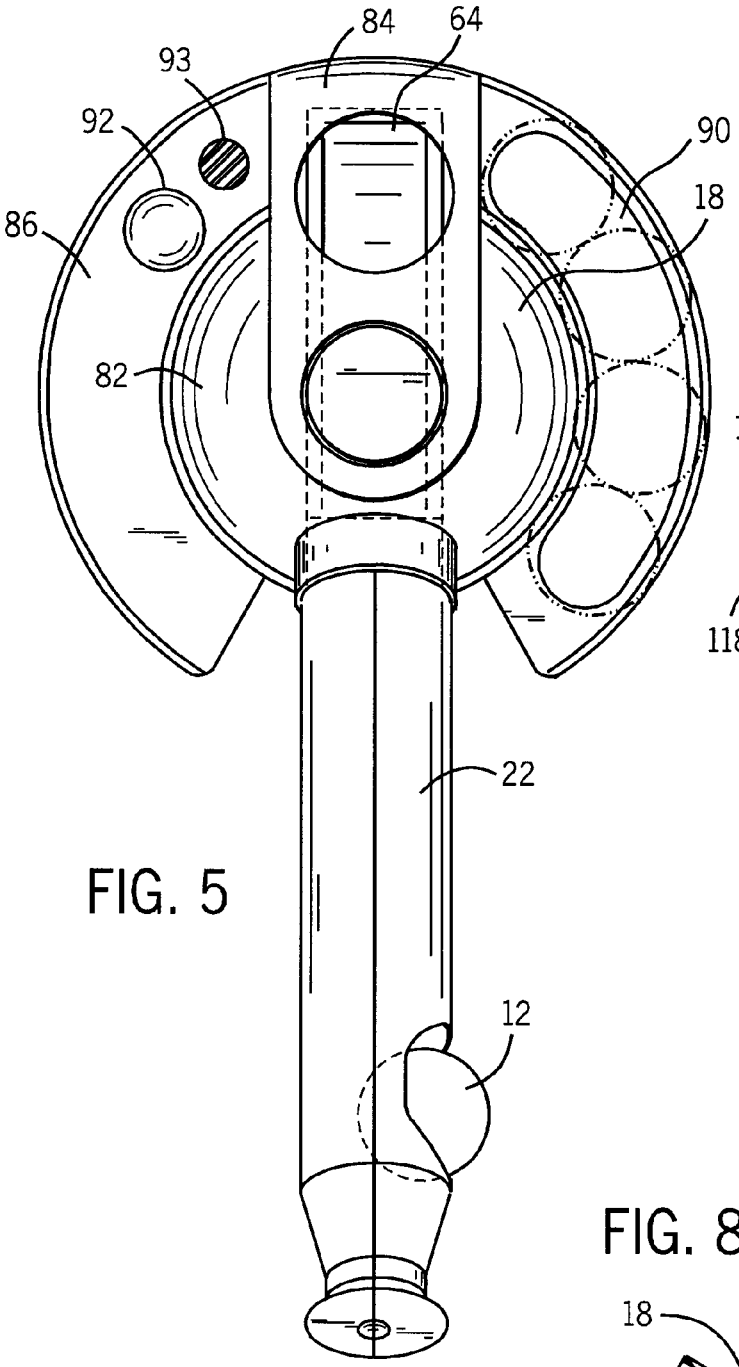
FIG. 5 is a top view of the baseball training apparatus of FIG. 1.

Referring to FIGS. 1, 2 and 5, the cover 18 is a generally circular structure having a center portion 82, a ball outlet region 84 and a rim 86. The center portion 82 has an upwardly extending convex shape and includes two openings, the inlet opening 62 positioned at one side of the center portion 82 and a tee opening 88 positioned at the top of the center portion 82. The ball outlet region 84 is formed to, and positioned adjacent to, the center portion 82. The ball outlet region 84 upwardly extends from the rim 86 and includes the ball outlet opening 64 positioned substantially opposite the ball inlet opening 62. The ball inlet and outlet openings 62, 64 are sufficiently sized to allow the ball 12 to freely pass into and exit from the apparatus 10. In an exemplary embodiment, the ball 12 is 2.75 inches in diameter. The rim 86 outwardly extends in a generally horizontal plane from the center portion 82 and from either side of the ball outlet region 84. In an exemplary embodiment, the rim 86 is approximately 2.875 inches wide and extends at least ninety degrees around the perimeter of center portion 82 and from either side of the ball outlet region 84.

The rim 86 includes a ball recess 90, a pushbutton opening 92 and speaker opening 93 (see FIG. 5). Referring to FIGS. 2 and 5, the ball recess 90 allows the rim 86 to support a plurality of the balls 12 particularly for when the apparatus 10 is used in the tee ball mode of operation. The pushbutton opening 92 allows the pushbutton 76 to upwardly extend past the rim 86. The sound produced by the sound emitting chip 74 (FIG. 9) passes through the speaker opening 93 of the cover 18. The cover 18 is configured to removably connect to the ring 30 of the base 16. In an exemplary embodiment, the cover 18 and the base 16 of the apparatus 10 have a diameter of 14 inches and a height of 6 inches. The cover 18 is made of hard plastic, but other materials such as wood, aluminum, etc. can be used.

Referring to FIGS. 3 and 4, the drive assembly 20 includes a drive assembly motor 94, an axle 96, a wheel 98, a flywheel 100 and a housing 102. The motor 94 is connected to the cover 18. The motor 94 is a dc motor coupled to the axle 96 and connected via wires to the power supply 38 and the control system 40. The motor 94 converts electrical energy of the battery 42 to rotational mechanical energy applied to the axle 96. The axle 96 is connected to the center of the wheel 98. In an exemplary embodiment, the wheel 98 includes an inner plastic hub and an outer foam covering 104. The wheel 98 rotates in response to rotation of the axle 96 caused by the motor 94 and imparts motion to each ball 12 coming in contact with the wheel 98.

The flywheel 100 is also connected to the axle 96 and is positioned adjacent to the wheel 98. In an exemplary embodiment the flywheel 100 has a thickness of approximately 0.125 inches and a diameter smaller than the diameter of the wheel 98 to ensure that the flywheel 100 does not contact the ball 12 during operation. The flywheel 100 provides additional weight to the drive assembly 20 thereby increasing the inertia of the drive assembly 20 and allowing the drive assembly 20 to resist a reduction in speed when the wheel 98 contacts the ball 12. The flywheel 100 also allows the drive assembly 20 to quickly return to normal operating speed after the wheel 98 contacts and projects the ball 12. The flywheel 100 is typically made of metal, but other flywheel materials, such as a ceramic material, can be used. The housing 102 is connected to the cover 18 and encompasses the drive assembly 20 leaving only the lowest portion of the wheel 98 exposed for contact with the ball 12. In an exemplary embodiment, the wheel 98 extends through the housing 102 by approximately one quarter of an inch. The housing 102 insulates sound emitted from the drive assembly 20 during operation and limits the exposure of the rotating components of the drive assembly to only the outer foam covering 104 of the wheel 98. This feature prevents potential injury in the event that a user, specifically a child, inserts an extremity (e.g. arm) through the ball inlet opening 62 or the ball outlet opening 64 of the cover 18 and into the apparatus 10. The housing 102 is made of hard plastic, but other materials, such as wood and aluminum, can be used. Alternatively, the drive assembly 20 can include a second wheel for contacting and projecting the ball 12. In another alternative embodiment, the motor 94 can be an ac motor powered by a remote power source. In another alternate embodiment, the drive assembly 20 can be a spring loaded actuation device having an automatically reset feature. In yet another embodiment, the drive assembly 20 can include a reciprocating motor connected to chamber configured to hold a pressurized fluid, such as air, where the pressurized fluid is periodically released to project the ball 12.

Figure 8:
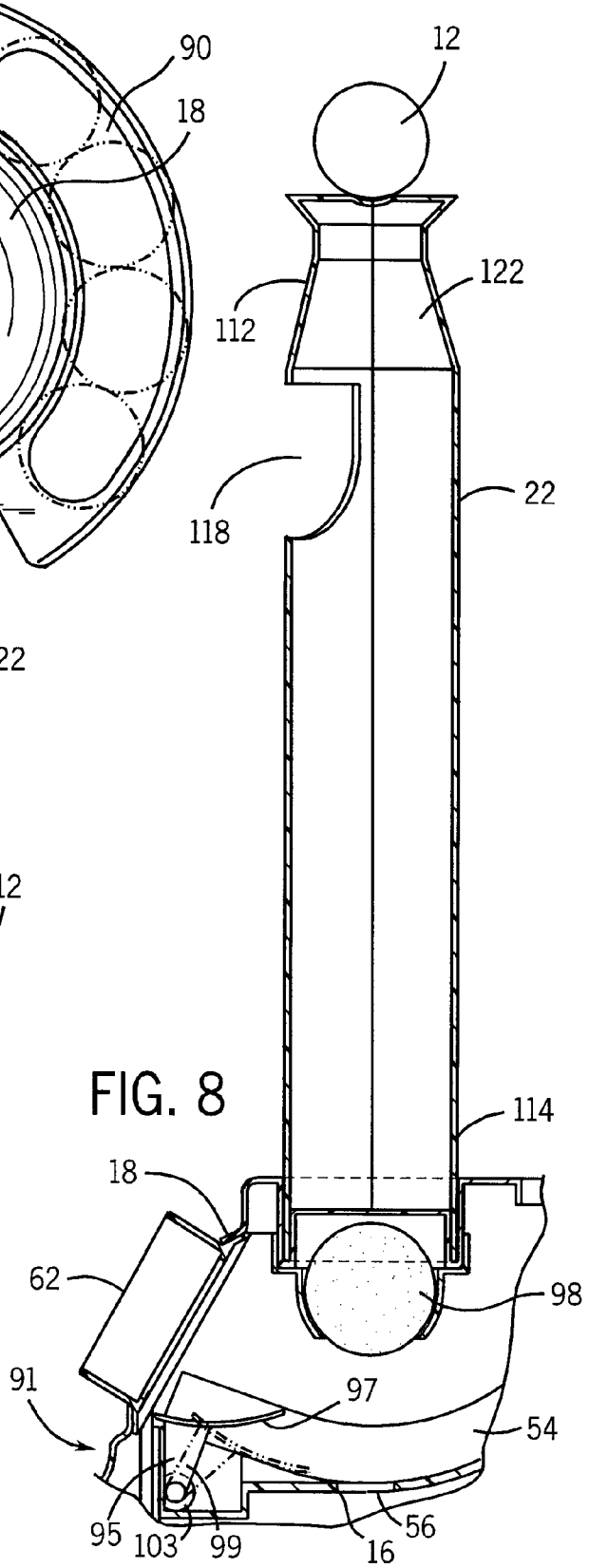
FIG. 8 is a longitudinal sectional view of the baseball training apparatus taken substantially along line 8—8 of FIG. 7.

Referring to FIGS. 3 and 8, in an exemplary embodiment, the ball interface device is a pivotable bracket assembly 91 including a ball interface motor 103 and a pivotable bracket 95. The ball interface motor 103 is coupled to the base 16 and the pivotable bracket 95. The ball interface motor 103 is electrically coupled to the power supply 38 and the control system 40 (FIG. 2). The bracket 95 includes an arcuate member 97 and a lever 99. The arcuate member 97 is positioned between the rails 54 of the ramp 36 adjacent to the inlet side 48 of the ramp 36. The lever 99 is pivotally connected to the output of the ball interface motor 103 and is fixedly connected to the arcuate member 97. The arcuate member 97 is configured to operate between a first and second position. In the first position, the arcuate member 97 is positioned in a substantially horizontal position such that the arcuate member 97 supports the lowest ball and prevents the remaining balls 12 within the ball feeder tube 22 from continuing to travel into the apparatus 10 and from contacting the wheel 98. In the second position, the bracket 95 pivots enabling the single ball 12 in contact with the arcuate member 97 to travel further along the ramp 36 and to contact the wheel 98. Upon receipt of a signal from the control system 40, the ball interface motor 103 is configured to transfer the bracket 95 between the first and second positions.

Figure 13:
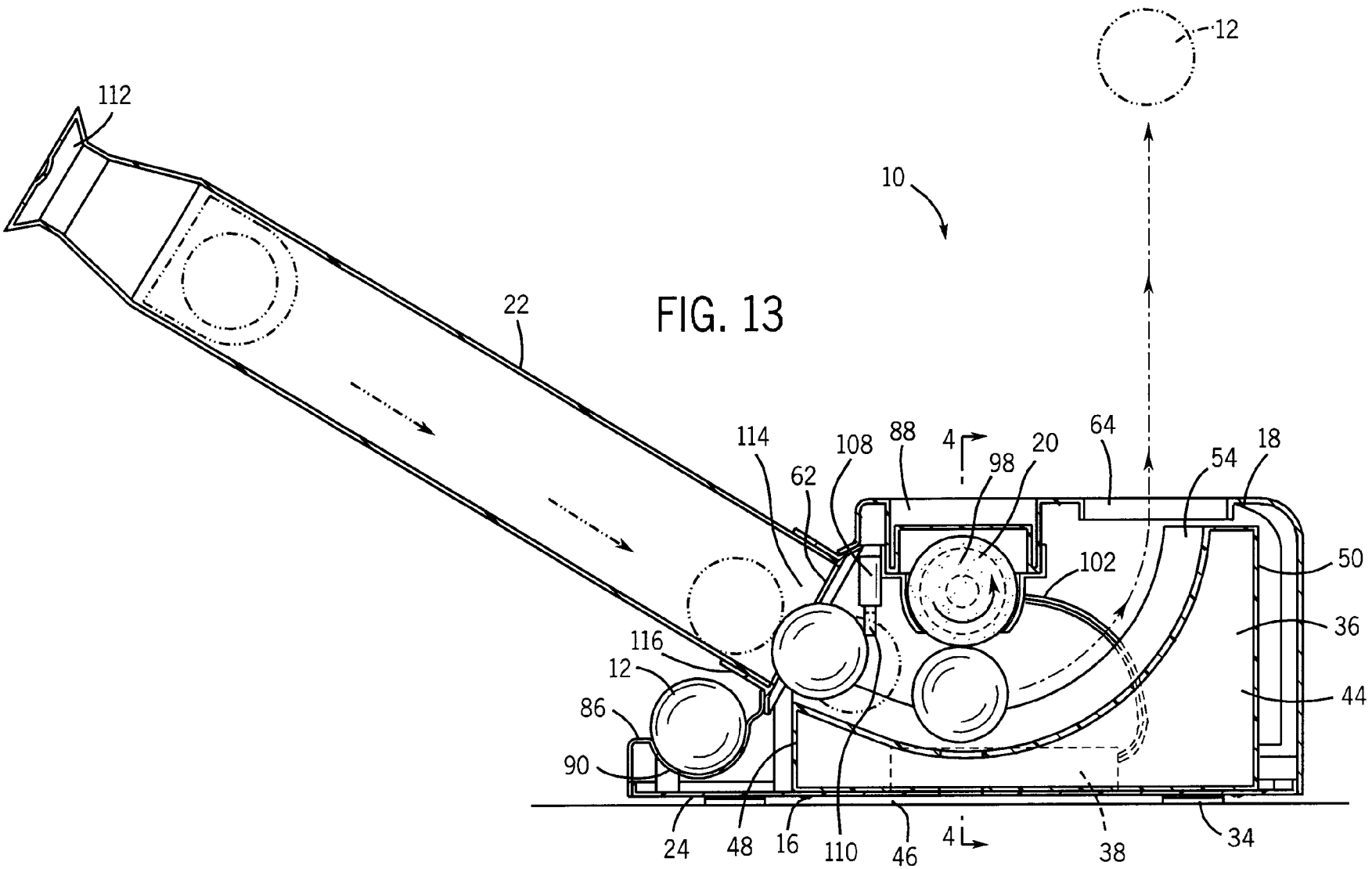
FIG. 13 is a longitudinal cross-sectional view of a baseball training apparatus in accordance with another alternative exemplary embodiment of the present invention.
Figure 14:
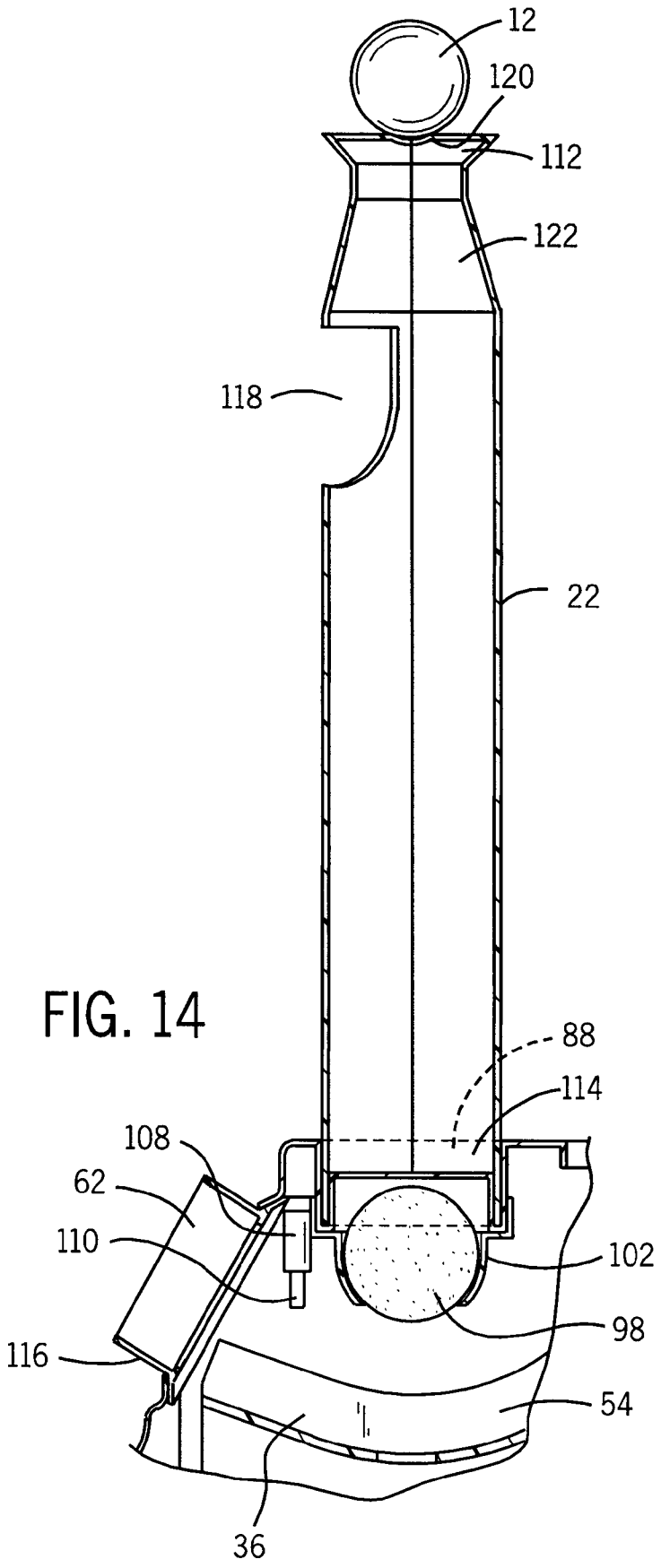
FIG. 14 is a longitudinal sectional view of the baseball training apparatus of FIG. 13.

Referring to FIGS. 13 and 14, in an alternative exemplary embodiment the ball interface device is a solenoid 108 connected to the cover 18 and coupled to the control system 40 and the power supply 38. The solenoid 108 includes a pin 110 movable between a first position in which the ball 12 is allowed to engage the wheel 98 and a second position in which the ball 12 is prevented from engaging the wheel 98. The pin 110 functions as a gate. In the first position, the solenoid 108 raises the pin 110 allowing a single ball 12 to roll along the rails 54 of the ramp 36 under the force of gravity, pass under the pin 110 and contact the wheel 98. In the second position, the solenoid 108 lowers the pin 110 preventing one or more of the balls 12 from contacting the wheel 98. Alternatively, the ball interface device can be a gate or a door movable between the first and second positions.

Figure 15:
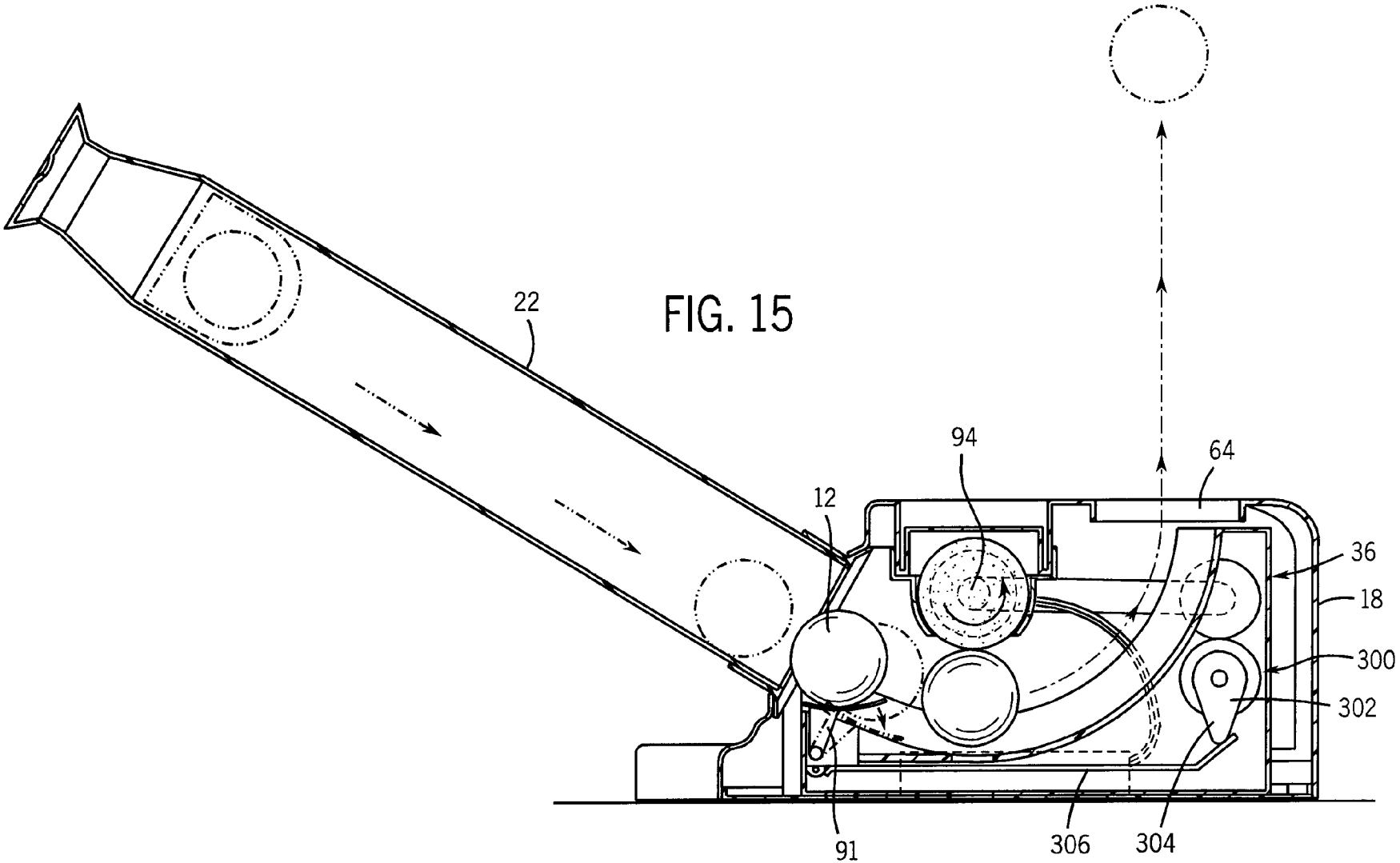
FIG. 15 is a longitudinal cross-sectional view of a baseball training apparatus in accordance with another alternative exemplary embodiment of the present invention.

Referring to FIG. 15, in another alternative embodiment, the control system can include a mechanical actuation and timing device 300 for controlling the operation of the ball interface device, such as the bracket assembly 91. FIG. 15 illustrates one possible embodiment for a mechanical activation and timing device 300, other configurations for a mechanical activation and timing device can be used and would be known to a person of ordinary skill in the art. In one embodiment, the mechanical actuation and timing device 300 can include a cam shaft assembly 302 having at least one cam lobe 304 and a ball interface device linkage 306. The cam shaft assembly 302 is coupled at one end to the motor 94. The coupling of the motor 94 to the cam shaft assembly 302 can be accomplished through a variety of gears, pulleys, belts or other means for achieving the desired number of revolutions per minute of the cam shaft assembly 302. The at least one cam lobe 304 is positioned such that the profile of cam lobe 304 contacts the ball interface linkage 306. The ball interface linkage 306 is coupled to the ball interface device. The mechanism activation and timing device 300 is configured to reposition the ball interface device at a predetermined interval from the actuation of the apparatus 10. The mechanical actuation and timing device 300 can also be used to reposition the ball interface device at a specific predetermined interval or frequency.

Referring to FIGS. 1 through 3, the ball feeder tube 22 is an elongate, hollow cylinder having a first end 112 and a second end 114. In the automatic ball projection mode, the second end 114 of the ball feeder tube 22 removably connects to the cover 18 at the ball inlet opening 62, and the first end 112 of the tube 22 is positioned at a higher elevation than the second end 114. In an exemplary embodiment, a reinforcing bracket 116 connects the second end 114 of the tube 22 to the cover 18 at the ball inlet opening 62. The reinforcing bracket 116 increases the strength and durability of the apparatus 10. The tube 22 further includes a passage 118 near the first end 112 of the tube 22. The passage 118 is sized to permit the ball 12 to enter the tube 22. In an exemplary embodiment, the tube 22 is a magazine capable of holding up to five balls. Alternate magazine sizes are contemplated. The second end 114 of the tube 22 is sized to allow the ball 12 to freely exit the tube 22. In an exemplary embodiment, the tube 22 is made of plastic, but other materials, such as wood, aluminum, etc., can be used.

Figure 7:
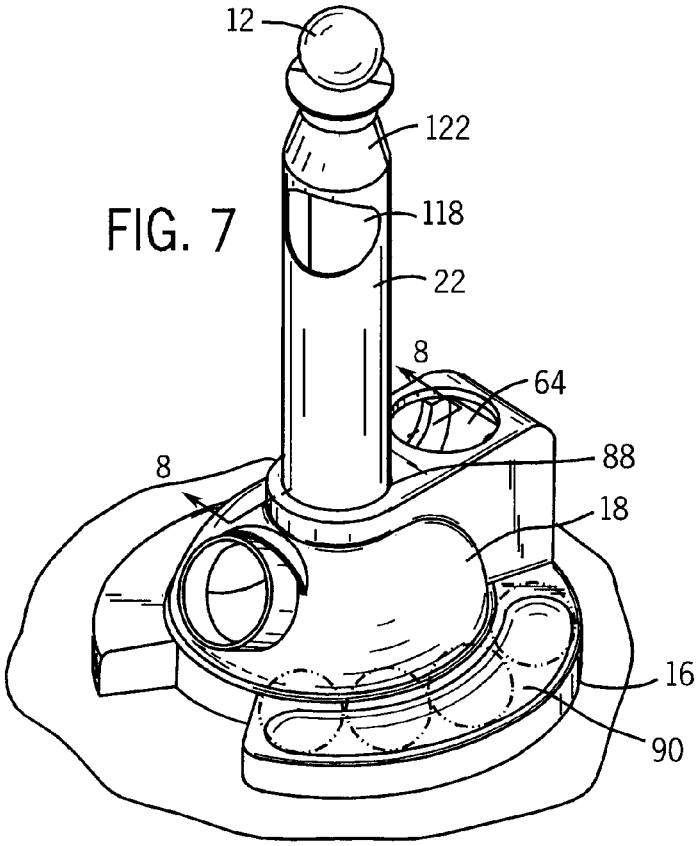
FIG. 7 is a perspective view of a baseball training apparatus in the tee ball mode of operation in accordance with an exemplary embodiment of the present invention.

Referring to FIGS. 7 and 8, in the tee ball mode of operation, the second end 114 of the tube 22 is removably inserted into the tee opening 88 of the cover 18. The first end 112 of the tube 22 includes a concave support surface 120 for maintaining the ball 12 above the apparatus 10. The first end 112 further includes a tapered section 122 positioned adjacent to and directly below the support surface 120. In an exemplary embodiment, the tapered section 122 is made of a flexible, resilient material capable of absorbing the force of a bat swung by a user that strikes the tapered section 122. In another exemplary embodiment, the first end 112 of the tube 22 is open and tapered to allow a ball to rest at the second end 114 of the tube 22, when the tube 22 is in the tee ball mode of operation.

The apparatus 10 is configured principally for outdoor use, therefore the control circuit case 78 and the power supply case 66 are constructed to prevent moisture and debris from contacting the control system and the power supply 38. The opening 56 (see FIG. 3) of the ramp 36 and the drain hole 32 (see FIG. 6) in the disk 24 allow water, such as rain water, that enters apparatus 10 through ball inlet opening or the ball outlet openings 62, 64 (see FIG. 2) to drain out of the apparatus 10. Additionally, the flange of the pushbutton 76 seals out water and debris from entering the apparatus 10 at the pushbutton opening 92 (see FIG. 5). Additionally, the flange of the pushbutton 76 seals out water and debris from entering the apparatus 10 at the pushbutton opening 92 (see FIG. 5).

Referring to FIG. 9, a representative embodiment of the control system 40 circuit diagram is illustrated. Other circuit diagrams are available and would be known to a person of ordinary skill in the art. The microcontroller 72 includes internal integrated logic, an internal clock, memory for storing a timer event and a processor for comparing time to the value of the timer event. The microcontroller 72 is coupled to the pushbutton 76, the power supply 38, the motor 94, the piezo-electric chip 74 and the ball interface device. The microcontroller 72 sends out positive voltage signals, according to the microcontroller's internal logic to a first transistor 126 connected to the motor 94, a second transistor 128 connected to the piezo-electric chip 74 and a third transistor 130 connected to the ball interface device. The positive voltage signals cause the motor 94, the piezo-electric chip 74 or the ball interface device to activate or re-position. The piezo-electric chip 74 emits a "beep" sound when actuated in order to warn the user that the ball 12 is about to be projected from the apparatus 10. This is achieved without the need for adding speakers to the control system 40. Thus, the piezo-electric chip 74 provides an inexpensive and effective warning signal function to the apparatus 10. In an alternative embodiment, at least one audio speaker is included in the control system 40 for emitting audible warning signals or messages to the user.

Figure 10:
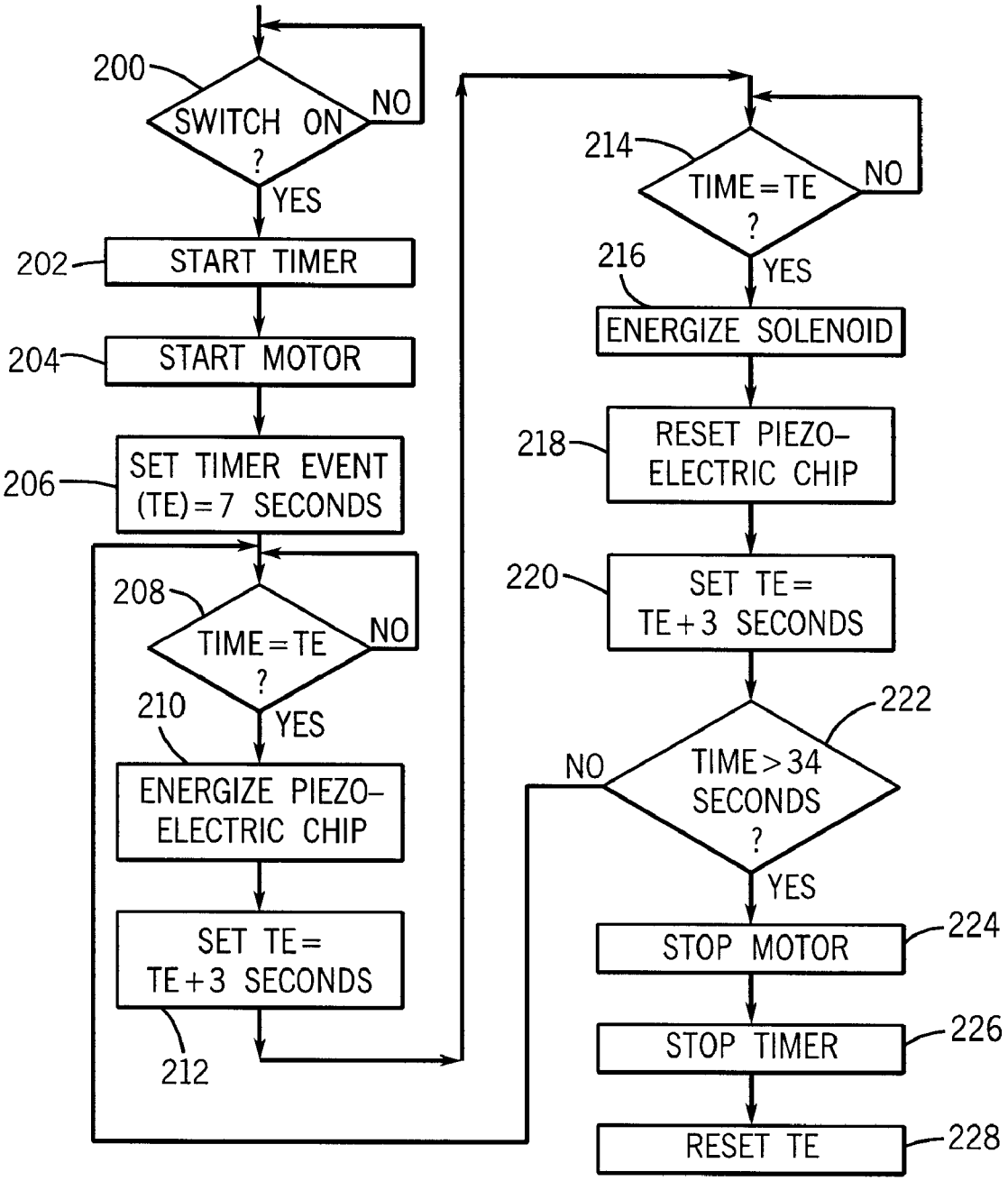
FIG. 10 is a flow chart showing the activity of the control system during the ball projection mode of operation.

Referring to FIG. 10, one exemplary embodiment of control system 40 integrated logic is illustrated. Other logic configurations are available, are contemplated, and would be known to a person of ordinary skill in the art. In an exemplary embodiment, as shown in FIG. 9, the control system 40 integrated logic begins with the pushbutton 76. When the pushbutton 76 is not pressed, nothing will occur, as shown at block 200. If pushbutton 76 is pressed, internal timer within the microcontroller 72 is activated, as shown at 202, the motor 94 receives a signal from the microcontroller 72 to activate, as shown at 204, and a timer event, stored in the microcontroller 72, is set at a first predetermined duration. In an exemplary embodiment, the first predetermined duration is set at approximately seven seconds, as shown at 206. Other duration settings can be used. The microcontroller 72 then determines if time equals the timer event (e.g., seven seconds), as shown at 208. If time does not equal the timer event, nothing further will occur. If time does equal timer event, the microcontroller 72 sends a signal to activate the piezo-electric chip 74, as shown at 210. In an exemplary embodiment, the microcontroller 72 signal to the piezo-electric chip 74 causes the chip 74 to emit a beeping sound at an increasing frequency until the chip 74 is reset. The microcontroller 72 also resets the timer event to a value equal to the previous timer event value plus a second predetermined duration. In an exemplary embodiment, the second predetermined duration is approximately three seconds, as shown at 212, but other duration settings can be used. The microcontroller 72 then determines if time equals the time event (e.g., ten seconds), as shown at 214. If time does not equal time event, nothing further will occur. If time equals the timer event, the microcontroller 72 sends a signal to re-position the ball interface device, as shown at 216. The microcontroller 72 signal to re-position the ball interface device holds the ball interface device in a repositioned state for a third predetermined duration equivalent to the time required for one ball 12 to the pass of the ball interface device and contact the wheel 98. When the third predetermined duration expires, the ball interface device returns to its original position. In an exemplary embodiment, the third predetermined duration is approximately one quarter of a second, but other duration settings can be used. The microcontroller 72 resets the piezo-electric chip 74, as shown at 218. The microcontroller 72 also resets timer event to a value equal to the previous timer event value plus a fourth predetermined duration. In an exemplary embodiment, the fourth predetermined duration is set at approximately three seconds, as shown at 220. Other duration settings can be used. The microcontroller 72 then determines if time is greater than a total cycle time. In an exemplary embodiment, the total cycle time is approximately thirty-four seconds, as shown at 222. If time is not greater than thirty-four seconds, the microcontroller 72 returns to 208 and determines if time equals the time event and steps 208 through 220 are repeated. If time is greater than thirty-four seconds, the microcontroller 72 stops the motor 94, as shown at 224, stops the timer, as shown at 226, and resets the timer event, as shown at 228. This automatic shutdown feature of the control system 40 preserves the life of the battery 42.

In summary, the control system 40 logic causes the apparatus 10 to function in the following manner. The user activates the apparatus 10 by pressing the pushbutton 76 once. Once activated, the control system 40 starts an internal timer and the motor 94. The control system 40 then provides a seven second warm-up period for the user to attain a ready batting position. At seven seconds, the apparatus 10 emits a beeping sound that increases in frequency for three seconds until first ball is projected from the apparatus 10 at a total time of ten seconds, at which time the beeping sound stops. Also, at ten seconds, the ball interface device repositioned for approximately one quarter of a second allows a single ball 12 to pass the ball interface device and contact the wheel 98. The beeping sound emitted by the apparatus 10 provides the user with an accurate warning signal of when the ball 12 will be projected from the apparatus 10. Three seconds later, the apparatus 10 re-initiates the beeping sound for a duration of three seconds, at which time a second ball is projected from the apparatus 10. This cycle repeats itself for a third, fourth and fifth ball. After the fifth ball is projected, the apparatus 10 automatically shuts down.

In the tee ball mode of operation, the second end 114 of the tube 22 is removably inserted into the tee opening 88 of the cover 18. The ball 12 is placed on the first end 112 of the tube 22 for hitting with the bat 14 by the user. In the automatic ball projection mode of operation, the second end 114 of the tube 22 is removably attached to the ball inlet opening 62 and the bracket 116. The user activates the apparatus 10 by pressing the pushbutton 76, with a foot, a hand or the bat 14. The apparatus 10 proceeds to emit a warning signal seven seconds later. The warning signal continues for three seconds at which time the ball interface device changes positions allowing the ball 12 to pass under the pin 110 of the ball interface device, and roll along the ramp 36 under the force of gravity until the ball 12 contacts the exposed portion of the wheel 98. The wheel 98 imparts motion on to the ball 12 causing the ball 12 to travel along the rails 54 of the ramp 36 and continue upward and exit the apparatus 10 through the ball outlet opening 64, where the ball 12 can be hit by the user. Three seconds later the warning signal reinitiates for a duration of three seconds at which time a second ball is projected from the apparatus 10. The warning signal and ball projection cycle repeats for a third, fourth and fifth ball. After the fifth ball is projected by the apparatus 10, the apparatus 10 automatically shuts down.

While a preferred embodiment of the present invention has been described and illustrated, numerous departures therefrom can be contemplated by persons skilled in the art, for example, the apparatus can be powered by a remote power source through a converter and an extension cord. According to another exemplary embodiment, the apparatus can be activated by a remote control device. Therefore, the present invention is not limited to the foregoing description but only by the scope and spirit of the appended claims.

What is claimed is:

1. A baseball training apparatus for use with at least one ball, comprising:

a body having a ball inlet opening, a ball outlet opening and a pathway for guiding the ball through the body;

a drive assembly connected to the body, the drive assembly configured to impart motion to the ball;

a ball interface device connected to the body, the ball interface device configured for movement between a first position in which the ball engages the drive assembly and a second position in which the ball is prevented from engaging the drive assembly;

a control system operably coupled to the ball interface device, wherein the control system interacts with the ball interface device by applying a signal to the ball interface device at a predetermined frequency, the control system interacting with the ball interface device such that the ball interface device changes between the first position and the second position at a predetermined time interval for a predetermined duration, thereby causing impartation of motion to the ball; and a sound transducer coupled to the control system configured for emitting a warning signal.

2. The baseball training apparatus of claim 1, wherein the interval of the signal to the ball interface device from the control system is at least two seconds, the duration of the signal is at least approximately 0.25 seconds, and the frequency is at least approximately two seconds.

3. The baseball training apparatus of claim 1, wherein the control system automatically shuts off the drive assembly at a predetermined shutdown time.

4. The baseball training apparatus of claim 1, further comprising an actuation device connected to the body and coupled to the control system.

5. The baseball training apparatus of claim 4, wherein the actuation device is a push button connected to the body.

6. The baseball training apparatus of claim 1, further comprising a power supply connected to the drive assembly and the control system.

7. The baseball training apparatus of claim 6, wherein the power supply includes at least one battery.

8. The baseball training apparatus of claim 1, further comprising a ball feeder tube having first and second ends, the first end of the tube removably connected to the body, the tube configured to store at least one of the balls.

9. The baseball training apparatus of claim 1, wherein the control system is a mechanical activation and timing device.

10. The baseball training apparatus of claim 1, further comprising a cord assembly coupled to the drive assembly and the control system, the cord assembly configures for connecting to a remote power source.

11. The baseball training apparatus of claim 1, further comprising an arcuate ramp connected to the body, the ramp defining the pathway for guiding the ball through the body.

12. The baseball training apparatus of claim 1, wherein the control system applies a sound emitting chip signal to the sound transducer at a second predetermined frequency for a second predetermined duration and the control system further applies the sound emitting chip signal at a third increasing frequency during the second predetermined duration.

13. The baseball training apparatus of claim 1, wherein the body includes a rim for holding at least one of the balls.

14. A baseball training apparatus for use with at least one ball, comprising:

a body having a ball inlet opening, a ball outlet opening and a pathway for guiding the ball through the body;

a drive assembly connected to the body, the drive assembly configured to impart motion to the ball;

a ball interface device connected to the body, the ball interface device configured for movement between a first position in which the ball engages the drive assembly and a second position in which the ball is prevented from engaging the drive assembly;

a control system operably coupled to the ball interface device, wherein the control system interacts with the ball interface device by applying a signal to the ball interface device at a predetermined frequency, the control system interacting with the ball interface device such that the ball interface device changes between the first position and the second position at a predetermined time interval for a predetermined duration, thereby causing impartation of motion to the ball; and at least one audio speaker coupled to the control system and configured for emitting a warning signal or at least one audible message.

15. A baseball training apparatus for use with at least one ball, comprising:

a body having a ball inlet opening, a ball outlet opening and a pathway for guiding the ball through the body;

a drive assembly connected to the body, the drive assembly configured to impart motion to the ball;

a ball interface device connected to the body, the ball interface device configured for movement between a first position in which the ball engages the drive assembly and a second position in which the ball is prevented from engaging the drive assembly; and a control system operably coupled to the ball interface device, wherein the control system interacts with the ball interface device by applying a signal to the ball interface device, the control system interacting with the ball interface device such that the ball interface device changes between the first position and the second position at a predetermined time interval for a predetermined duration, thereby causing impartation of motion to the ball, the control system further includes a voice recognition module, the module configured to convert a verbal command into a signal, which is applied by the control system to the ball interface device.

16. The baseball training apparatus of claim 15, further comprising a ball feeder tube having first and second ends, the first end of the tube removably connected to the body, the tube configured to store at least one of the balls.

17. The baseball training apparatus of claim. 15, farther comprising an arcuate ramp connected to the body, the ramp defining the pathway for guiding the ball through the body.

18. The baseball training apparatus of claim 15, wherein the body includes a rim for holding at least one of the balls.

19. A baseball training apparatus for use with a plurality of balls, comprising:

a body having a ball inlet, a ball outlet and a pathway for guiding the ball through the body;

a ball feeder tube removably connected to the body, the ball feeder tube configured to hold the balls;

a ball delivery means coupled to the body;

a ball projection means coupled to the body, the ball projection means configured for projecting a ball generally vertically from the body; and a control system coupled to the ball projection means and the ball delivery means, the control system providing an actuation signal to the ball delivery means at a first predetermined frequency, wherein the ball delivery means is a solenoid coupled to the control system and the ball projection means is a wheel coupled to a dc motor, the wheel is configured to impart motion onto the ball.

20. The baseball training apparatus of claim 19, wherein a distal end of the ball feeder tube is formed to support the ball when the ball feeder tube is removably connected to the body, such that the ball feeder tube is positioned in a substantially vertical position.

* * * * *